United States Patent [19]

Lichtenberg

[11] 3,996,836

[45] Dec. 14, 1976

[54] APPARATUS FOR TRANSPORTING AND CHARGING UNCARTRIDGED EXPLOSIVES, MORE PARTICULARLY PLASTIC EXPLOSIVES

[75] Inventor: Hubert Lichtenberg, Dortmund-Lottringhausen, Germany

[73] Assignee: Dynamit Nobel Aktiengesellschaft, Troisdorf, Germany

[22] Filed: May 5, 1975

[21] Appl. No.: 574,747

[30] Foreign Application Priority Data

June 26, 1974 Germany ..... 2430632

[52] U.S. Cl. ..... 86/20 C; 222/95

[51] Int. Cl.[2] ..... C06D 5/04

[58] Field of Search ..... 222/95, 386.5; 86/20 C

[56] References Cited

UNITED STATES PATENTS

| | | | |
|---|---|---|---|
| 1,632,559 | 6/1927 | Pedrick | 222/386.5 |
| 2,387,598 | 10/1945 | Mercier | 222/386.5 |
| 2,529,937 | 11/1950 | Hale | 222/386.5 X |
| 2,903,969 | 9/1959 | Kolbe | 86/20 C |
| 3,162,328 | 12/1964 | Frume | 222/386.5 |
| 3,170,366 | 2/1965 | Alfredsson | 86/20 C |
| 3,836,335 | 9/1974 | Eppes | 222/386.5 |

FOREIGN PATENTS OR APPLICATIONS

| | | |
|---|---|---|
| 512,055 | 10/1971 | Switzerland |

*Primary Examiner*—Allen N. Knowles
*Attorney, Agent, or Firm*—Malcolm W. Fraser

[57] ABSTRACT

A hollow container having two chambers separated by a diaphragm. A flowable explosive is carried in one chamber and an incompressible fluid is forced into the other chamber as needed, thereby flexing the diaphragm and forcing out the explosive into a dispensing hose. The dispensing hose includes a nozzle with a seal for placing the explosive in a bore hole. The explosive being dispensed can be accurately metered.

2 Claims, 3 Drawing Figures

APPARATUS FOR TRANSPORTING AND CHARGING UNCARTRIDGED EXPLOSIVES, MORE PARTICULARLY PLASTIC EXPLOSIVES

This invention relates to apparatus for transporting uncartridged explosive, more particularly flowable explosive, to its place of use and for charging a plurality of blast-holes by means of a container, in which a displacer is provided for emptying purposes, one side of the displacer bounding an explosive supply chamber while its other side bounds a pressure chamber which can be subjected to a pressure medium adapted to be introduced into the container.

The invention can be applied to blastig operations generally and to blasting in underground and above-ground mining in particular. The shot-hole can be filled with uncartridged explosive, whereas if the charge consists of cartridges there must be a free space between the charge and the wall of the shot-hole and this entails a considerable loss of explosive power. Uncartridged explosives therefore permit a comparatively low specific consumption of explosives and a reduction of the number of shot-holes per square metre. ANC explosives (ammonium nitrate carbon support), which are also used in the uncartridged state, have consequently already replaced explosive cartridges in numerous cases. Explosives in the form of slurries, to which the invention particularly relates, have a higher density and therefore give a higher charge weight per shot-hole metre than ANC explosives.

The explosives must be brought to the site in closed containers. It is generally assumed that the sensitivity of the explosives must be increased in inverse proportion to the explosive charge diameter. The explosives used for blasting in small diameter blast-holes of about 30 to 50 mm, as occur in underground and above-ground mining, should therefore be protected from mechanical stresses as far as possible.

An apparatus is already known (Swiss Pat. No. 512,055), in which a container is filled with explosive at the works. The explosive supply chamber is emptied into a shot-hole in situ. The container consists of a tube containing a displacer in the form of a piston. The latter is moved by compressed air or mechanically. The disadvantage of this apparatus is that correspondingly large number of such devices is required for charging a number of holes, and hence outlay is high in terms of transportation. The system also subjects the explosive to high mechanical stress so that the apparatus cannot be used for sensitive explosives.

Devices are also known which are filled with explosive in situ and the explosive must therefore be brought up to the side in separate containers. These devices serve solely to charge the explosive.

In another known device for charging shot-holes, a pump is disposed beneath the container to force the explosive out of the latter and into an explosive conveying hose. Given a fixed pump delivery, the explosive can be metered in this way but the disadvantage of the pump is that it subjects the explosive to high mechanical stress and therefore the device cannot be used for sensitive explosives. Generally, the pump can be used for accurate metering of the amount of explosive only by means of a correspondingly complicated control system, and remote control of the pump causes difficulty.

The object of the invention is to provide an apparatus which is suitable for the transportation of uncartridged explosive, particularly flowable explosive to its place of use and for charging the explosive in metered quantities, and which can be used for sensitive explosives and hence for small-diameter shot-holes, and is of such a simple construction that it is economic for transportation.

According to the invention, in apparatus of the above specified kind, to this end the displacer secured in the container is flexible or extensible under the pressure of the pressure medium and surrounds at least a part of the explosive in the explosive supply chamber and bears against the walls thereof when the container is empty.

This construction of the displacer enables the container to be filled except for the small space required to accommodate the displacer. After the pressure medium has been admitted, the displacer flexes over and in so doing forces the explosive completely out of the container.

The apparatus can be used to meter the explosive by controlling the amount of flexing of the displacer. The displacer has no friction whatever and hence subjects the explosive to practically no stress. The displacer can be made of any elastic or elastomeric material and does not therefore represent any appreciable expenditure in the transportation container.

More particularly, the apparatus according to the invention is characterized in that a pressure medium metering device is provided upstream of the container pressure chamber receiving substantially incompressible pressure medium. The service water available in situ is particularly suitable as pressure medium, it only being necessary to provide a pressure limiting means if necessary. The amount of explosive flowing out can be determined very accurately by observing the metering device.

The displacer advantageously consists of a foil, a sheet or sheeting or the like because it occupies only a small amount of space when the container is filled.

More particularly, the container is divided and the displacer is secured by clamping its edges between the container parts.

If the foil, sheet or sheeting or the like used consists of elastic or elastomeric material, the deformation of the same required for complete emptying of the container on the flexing of the displacer should be advantageously be controlled to some extent. To this end, in one embodiment of the invention, an elastic or elastomeric connection to the wall of the pressure chamber situated opposite the displacer is provided in the middle of the latter. In this embodiment of the invention, therefore, the displacer initially undergoes deformation at its edges, so that the explosive is pressed inwards from the container wall. Only after expansion of the connection is the explosive in the middle displaced from the container.

Since it is intended that the apparatus according to the invention should be re-used repeatedly, additional steps will usually be taken to prevent damage of the displacer when the explosive chamber is completely emptied. To this end, in another embodiment of the invention, a discharge aperture in the explosive chamber is surrounded by a bearing disc and the displacer has a reinforcement cooperating therewith. As soon as the displacer has displaced the explosive from the container, the reinforcement bears on the bearing disc so that the displacer is prevented from being displaced out of the container.

Pressures of the order of 2 to 6 bars will generally be sufficient for the incompressible medium for the purpose of metering and emptying the container. To keep material costs as low as possible, in one embodiment of the invention, the container is spherical and is divided into two halves which, for connecting purposes, have flanges, for example, between which the circular edge of the displacer is clamped, the poles of the sphere being provided with a connection for a water pipe and for a home for conveying the explosive to the shot-holes. Apparatus of this kind can be made, for example, mainly from plastics, and transparent plastic, for example, can be used for the container. The advantage of having a transparent container is that it is possible to observe the explosive being discharged and determine from outside whether the container has been completely emptied. Containers of this kind need be opened, filled and closed, and usually lead-sealed, only by the explosive manufacturer to prevent unauthorized persons from removing explosive material.

If the explosive is metered by means of pressure medium, then advantageously a flowmeter is used for metering purposes. In such cases it is possible to use a flow indicating and telemetric device on the explosive conveying hose remote from the container so that the operatives charging the shot-holes can immediately have an indication of the amount of explosive.

Alternatively, the quantity of explosive can be metered by observing the length of hose projecting from a shot-hole at any time. The explosive hose end remote from the container is then advantageously provided with a nozzle which bears a seal abutting the shot-hole wall. This seal ensures that the explosive cannot pass the hose and reach the exterior.

According to another feature of the invention, the seal may be detachably secured on the nozzle and an automatic closure is provided for the nozzle seal opening with the resulting advantage that after the charging operation a column of explosive is completely sealed off to the exterior in the shot-hole.

An advantageous embodiment of the invention for this purpose is one in which the nozzle is formed by a tube which has an annular recess to receive the edge which is adapted to be fitted into the latter and which surrounds the seal aperture.

In some cases, however, it is inevitable that the explosive will penetrate into cracks and fissures in the rock so that observation of the explosive feed along does not give adequately accurate metering of the explosive. For such cases the invention purposes to fit a flexible hose over the explosive conveying hose or its nozzle, said hose surrounding the explosive in the shot-hole. The emerging explosive then first enters the hose and as the displaced amount of explosive increases it draws the hose away from the explosive conveying hose or its nozzle and into the shot-hole. If the foil, sheet or sheeting or the like used for such a hose is sufficiently thin the explosive will completely fill the shot-hole despite the hose.

The invention will be explained in detail hereinafter with reference to one exemplified embodiment illustrated in the drawing wherein.

Figure 1:
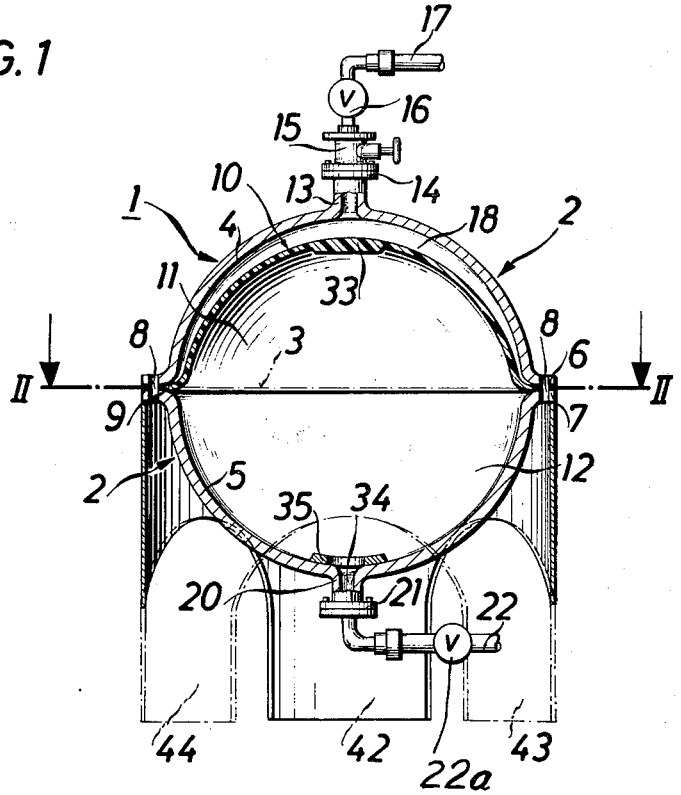
FIG. 1 is an elevation of the apparatus according to the invention showing the supply and discharge lines broken off.
Figure 2:
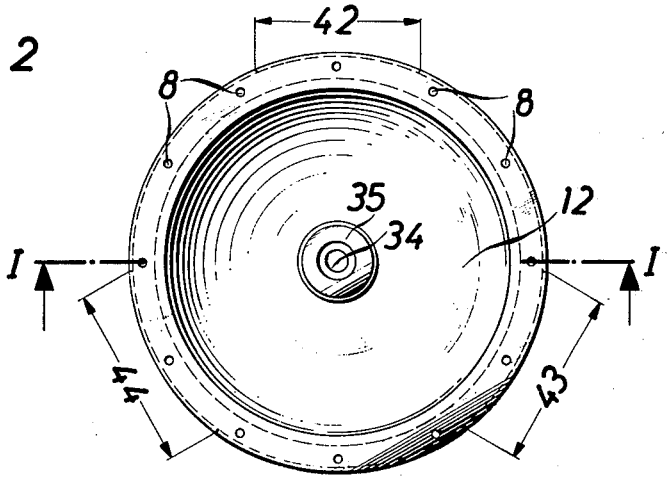
FIG. 2 is a plan view of FIG. 1 in partial section on line II—II.

The apparatus bearing the general reference 1 as shown in the Figures is intended for the transportation, more particularly of flowable explosive, to its place of use and for charging a plurality of blastholes. The apparatus consists essentially of a container 2 which is divided into two in the exemplified embodiment illustrated. The container has the shape of a sphere divided along its plane 3 which represents the equator of the sphere. In the region of the equatorial plane 3 each hemisphere 4, 5 has a flange 6, 7 respectively. The flanges are formed with holes 8 for screws (not shown) which are usually lead-sealed. The circular edge 9 of a foil, sheet or sheeting or the like forming a displacer 10 is provided between the flanges 6 and 7 and in the exemplified embodiment illustrated is so shaped as to be able to bear from inside against one of the hemispheres 4, 5 when the said foil, sheet or sheeting or the like is in the stretched state.

If an elastic or elastomeric material is provided for the displacer 10, the elastic or elastomeric properties can be utilized to expand the foil, sheet or sheeting or the like so that it is applied against the inner walls of the hemi-sphere 4, 5 only after it has expanded.

In the exemplified embodiment shown in FIG. 1, the displacer 10 is bearing against the inner wall of the hemi-sphere 4. The foil, sheet or sheeting or the like forming the displacer 10 bounds one part of an explosive supply chamber 11, the other part 12 of which is bounded by the walls of the hemi-sphere 5.

In the region of its pole, the top hemi-sphere 4 has a tubular spigot 13 terminating in a flange 14. A cock 15 is connected to this flange, for example by means of bolts. In the exemplified embodiment illustrated, a relief pressure valve 16 (shown only diagrammatically) is secured to the cock and is followed by a hose 17 leading to a water pipe (not shown). A pressure chamber 18 is thus formed between the displacer 10 and the inner wall of the hemi-sphere 4 and when the cock 15 is opened this chamber can be filled with water under pressure.

Figure 3:
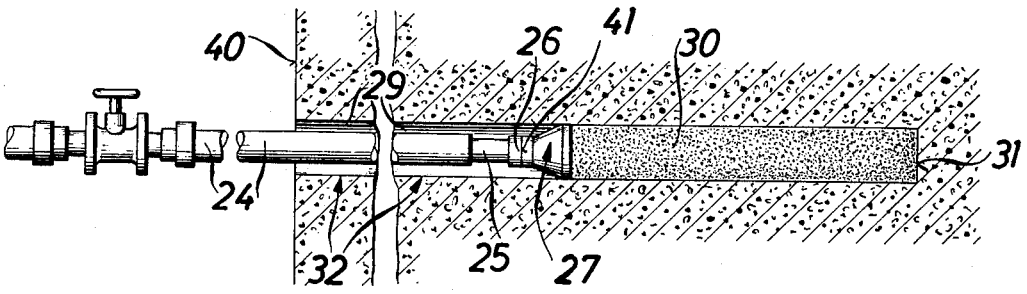
FIG. 3 is a diagrammatic longitudinal section of a shot-hole filled with the apparatus according to the invention.

A spigot 20 terminating in a flange 21 is also provided in the region of the pole of the hemi-sphere 5. Flange 21 is followed by a hose 22 containing a shut-off valve **22*a*. The hose end remote from the container 2 has the reference 24 in FIG. 3 and terminates at a tube 25 having a collar 26. A substantially funnel-shaped seal 27 consisting, for example, of thermoplastic material bears against the collar and is slipped over that end of the tube 25 which is situated beyond the collar 26. The collar prevents the seal 27** from slipping farther over the tube.

The container 2 is filled with flowable explosive at the factory. The hose 17 is connected in situ. The cock 15 is opened to fill the pressure chamber 12 with water, as a result of which the displacer caves in and forces the explosive out of the chamber 11 into a spigot 20 and through the hose 22 into the borehole 29. The explosive 30 fills the latter starting from the base 31 thereof, the seal 27 ensuring that no explosive can get past the tube 25 and the hose 24 into the still unfilled region 32 of the borehole.

When the container 2 is empty, the displacer 10 assumes in the hemi-sphere 5 substantially the same position as it had in the hemi-sphere 4 when the container was filled. The foil, sheet or sheeting or the like forming the displacer 10 has a reinforcement 33 substantially in the middle and in the exemplified embodiment illustrated this is obtained by a corresponding thickening of the foil, sheet or sheeting or the like. The aperture 34 of the spigot 20 in the hemi-sphere 5 is surrounded by a perforate disc 35 on which the thickened portion 33 of the foil, sheet or sheeting or the like bears when the container is empty. This ensures that the displacer 10 cannot fall into the spigot 20 or hose 22.

A flowmeter (not shown) may be provided in the region of the cock 15 or relief pressure valve 16. The amount of explosive displaced from the container 2 can be checked by observing the flowmeter so that the amount of explosive 30 introduced into the borehole 29 can be metered.

A flow indicating and telemetric device (not shown) covers the flow as far as the hose 24 so that the operatives filling the borehole can have an indication of the amount of explosive.

The tube 25 forms a nozzle for the explosive feed hose 22, 24. The seal 27 may have an automatic closure for its aperture through which the front end of the nozzle 25 adjacent the collar 26 passes.

Since the pressure chamber 12 of the container 2 is filled with an incompressible pressure medium and accordingly the amount of pressure water is a sufficiently accurate indication of the amount of explosive displaced and hence the metered quantity of explosive 30, a flowmeter may be dispensed with, in which case it is advantageous to provide the nozzle 25, 26 or the front end of the hose 24 with graduations to show the distance between the column of explosive 30 and the mouth 40 of the borehole. This also gives an accurate indication for metering the explosive 30.

When the borehole cuts through cracks or fissures through which explosive can pass out of the borehole into the surrounding rock, it is advisable to pull a hose of thin foil, sheet or sheeting or the like over the nozzle 25, 26, the explosive 30 being displaced into said foil, sheet or sheeting or the like, which pulls away from the nozzle as the column of explosive increases.

Instead of using a collar 26, the rear edge 41 of the seal 27 may fit into an annular opening of the nozzle, the seal 27 having its fitted-in edge pulled away from the nozzle 25 as soon as the predetermined amount of explosive has been introduced into the borehole.

At least the apparatus container 2 may consit of thermoplastic material, preferably a transparent plastic, for example an acrylic plastic. In this way it is possible to check the filling of the container 2 at any time.

In the exemplified embodiment illustrated the spherical container 2 is used in situ in a base provided with four legs 42, 43. In this way it can be made ready on the site and be transported relatively easily.

Of course the spherical form of container shown in the drawings has been selected only from considerations of pressure-tightness. From other considerations, for example ease of stacking, the container may be replaced by a cubic shape.

What I claim is:

1. Apparatus for transporting uncartridged flowable explosive to its place of use, and for charging blast holes comprising A. a spherical container divided into two hemispheres, each hemisphere containing a pole, the container being separable upon a substantially equatorial line into the two hemispheres which define walls of a pressure chamber and an explosive supply chamber respectively, B. a displacer within said spherical container and confined between said hemispheres to define a boundary between the pressure chamber and the supply chamber and consisting of elastomeric material, C. a thickened enlargement of said displacer substantially in the middle thereof, D. a valve-controlled first spigot in the region of the pole of the hemisphere which defines walls of the pressure chamber, E. means for introducing an incompressible pressure fluid through the first spigot into the pressure chamber for flexing said displacer, F. an explosive outlet second spigot at the pole of the hemisphere which defines the walls of the explosive supply chamber, G. an aperatured bearing disc on the inside of said pressure chamber aligned with the first spigot and against which said thickened enlargement is adapted to bear, H. a nozzle for extending into a blast hole for delivering explosive thereto, I. an explosive conveying hose which has an opening on one end connected to the second spigot and an opening at the other end connected to the nozzle and is completely closed elsewhere for exclusively conveying the contents of the explosive supply chamber to and through the nozzle, and J. a seal on the end of said nozzle for militating against the flow of any material conveyed by the hose back past the nozzle into the unfilled region of the bore hole.

2. Apparatus as claimed in claim 1, in which said seal is generally funnel-shaped with the wider end foremost to bear against the wall of the blast hole.

* * * * *